US006525258B1

(12) United States Patent
Powers

(10) Patent No.: US 6,525,258 B1
(45) Date of Patent: Feb. 25, 2003

(54) ELECTROMECHANICAL MUSICAL INSTRUMENT PICKUP

(75) Inventor: Michael V. Powers, Meridian, MS (US)

(73) Assignee: Peavey Electronics Corporation, Meridian, MS (US)

( * ) Notice: Subject to any disclaimer, the term of this patent is extended or adjusted under 35 U.S.C. 154(b) by 0 days.

(21) Appl. No.: 10/092,563

(22) Filed: Mar. 8, 2002

(51) Int. Cl.[7] ..... G10H 3/18
(52) U.S. Cl. ..... 84/728
(58) Field of Search ..... 84/725–728

(56) References Cited

U.S. PATENT DOCUMENTS

| | | | | |
|---|---|---|---|---|
| 2,896,491 | A | 7/1959 | Lover | 84/1.15 |
| 2,897,709 | A | 8/1959 | McCarthy et al. | 84/1.15 |
| 2,964,985 | A | 12/1960 | Webster | 84/1.15 |
| 3,711,619 | A | 1/1973 | Jones et al. | 84/1.15 |
| 4,283,982 | A | 8/1981 | Armstrong | 84/1.15 |
| 4,501,185 | A | 2/1985 | Blucher | 84/1.15 |

*Primary Examiner*—Stanley J. Witkowski
(74) *Attorney, Agent, or Firm*—Dykema Gossett, PLLC

(57) ABSTRACT

A musical instrument pickup having a central core bobbin with a first winding wound around the central core bobbin and a second winding wound around the first winding. Both ends of each winding are attached to a respective termination point. Each termination point is connected to an amplification source wherein the tones of the instrument strings are amplified.

13 Claims, 2 Drawing Sheets

ELECTROMECHANICAL MUSICAL INSTRUMENT PICKUP

FIELD OF THE INVENTION

The invention relates to an electromechanical transducer for musical instruments and more particularly to an electromagnetic pickup for a guitar.

BACKGROUND OF THE INVENTION

Electricomagnetic transducers are used on electrical musical instruments to neutralize the effects if currents induced by adjacent electrical devices and for converting the vibrations created, when the strings of the instrument are played, into an electrical output wherein the sounds are amplified.

Conventional electrical pickups are prone to humming noises in attached amplification devices due to currents created by adjacent electrical devices that are transferred to the guitar pickup. A common way of counteracting the hum and amplifying the sound of the guitar is to wind the pickups with two different gauges the same number of turns on each coil. The dual winds allow greater flexibility of tonal shaping or tuning of each coil. Likewise, when used on a single coil, non-hum cancelling device, initial winds can be connected in series to secondary winds to produce a sound with a pronounced increase in volume DC resistance similar to the output of a dual coil device. By using an external switching device, connection between the initial and secondary winds can be tapped and either set of winds can be shunted to ground. Thus, the second tone and output parameters can be achieved that are closer to that of normal, single cole type devices.

The current state of the prior art provides pickups using a single gauge wire and tap that is drawn to ground, and with a secondary lead is attached to the coil wire at a predetermined point in the number of turns in the wire, thereby allowing a signal from turns of wire up to that connection to be sensed in the circuit.

While the desired frequency response may have been achieved in these configurations, the output or DC resistance is diminished due to fewer number of turns of wire being sensed in the circuit.

A solution to the problem of reduced DC resistance is to increase the amplitude of the device. This is accomplished by using more magnets to produce much greater flux in the device. However, due to the proximity of the magnets with the steel core strings, the vibration of the strings is dampened by the increase in magnetic flux necessary to achieve desired volume when the coil of wire is tapped at a predetermined point.

Using a dual wind pickup will resolve the dampening problem by allowing a sufficient number of initial turns to reproduce desired single coil tonality, yet not diminish the output due to use of different gauge wire without the addition or larger magnets. When secondary turns of different gauge wire are added, the sum of both the number of turns yields a much greater signal.

SUMMARY OF THE INVENTION

An object of the present invention is to provide a musical instrument transducer that allows flexibility in tonal shaping or tuning of each wire coil.

Another object of the present invention is to provide a musical instrument pickup that is dual wind using two different gauges of wire.

The various objects of the present invention are realized with a musical instrument pickup having a plurality of turns of a given gauge wire on a bobbin or coilform. Each end of each wire is terminated on a metal terminal strip attached to the bobbin or coilform. A second plurality of turns of a different gauge wire are wound on top of the initial turns of the wire. When the secondary turns of wire are completed, both ends of the wire are terminated on individual terminal strips attached to the bobbin or coilform. The coils wound in this manner may be used individually or two or more coils may be connected in series to form a hum cancelling device.

The bobbin or coilform can have a wire attached to each terminal thereby allowing the signal of each individual set of winds to be sensed either as a series connection wherein both the initial and secondary winds are sensed together, or individually wherein either of the winds may be connected to a circuit or switching device thereby enabling initial turns, secondary turns, or both to be sensed. For example, the initial winds of two adjacent coils only may be sensed or secondary (outside winds) may be sensed only. The desired frequency response can be controlled based on the side of the gauge of wire used in the initial and secondary winds.

The present pickup achieves the objectives set forth by having a central core bobbin or coilform with a first winding wound around the central core of the bobbin, and a second winding wound around the first winding. Both ends of each winding are attached to a respective termination point. Each termination point is connected to an amplification source wherein the tones of the instrument strings are amplified.

DESCRIPTION OF THE PREFERRED EMBODIMENT

Figure 1:
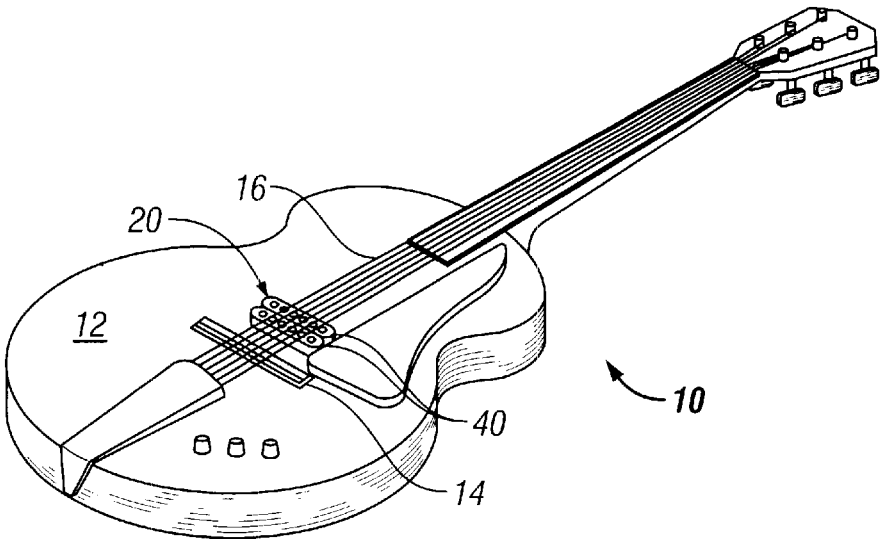
FIG. 1 is a perspective view of a musical instrument, with a pickup of the present invention thereon.

The present invention is illustrated in use in the perspective view of a stringed instrument 10 as shown in FIG. 1. The musical instrument pickup 20 of the present invention is to be used with a musical instrument 10 having strings 16 that are stretched between the head 18 and the bridge 14. The musical instrument pickup 20 can be connected in an inductive capacity to the body 12 of the musical instrument 10 underneath the strings 16 and somewhere between the bridge 14 and the head 18, in close proximity of the bridge 14. The pickup 20 shown in FIG. 1 has dual bobbins 40, however a single bobbin 40 may be used.

The pickup 20 can be used with any musical instrument 10 that is connected to any type of amplification source wherein the pickup 20 provides a mechanism for amplifying the sounds generated by the vibrating strings, yet reducing the hum noises that arise when electrical devices are located near the amplifier.

Figure 2:
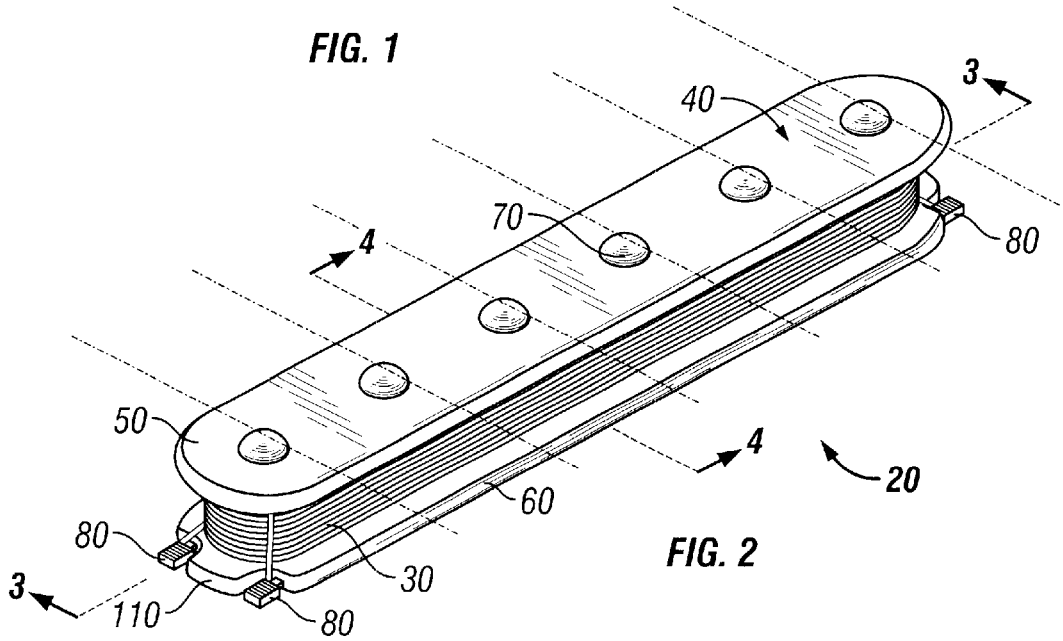
FIG. 2 is a perspective view of the pickup.

A pickup 20 having a single bobbin or coil 40 is shown in FIG. 2. The pickup 20 has a top plate 50 and a lower plate 60 with wire 30 wound around a central core 140. The bobbin 40 can be attached to a musical instrument 10 by any conventional attachment means, but not limited to the screw connectors 70 as shown in the preferred embodiment. Each screw connector 70 extends through the top plate 50, central core 140 and lower plate 60 with a threaded end 150 protruding from the bottom side of the lower plate and can be screwed into the body of the musical instrument.

Located at each end of the bobbin 40 are a plurality of termination points 80 to which the ends of the wire 30 are attached. Conductor cables or extension wires (not shown) are also attached to said termination points 80 and connect each termination point 80 to the jack of the musical instrument 10. Such an arrangement essentially connects the pickup 20 with the amplification device which is connected to the jack of the musical instrument 10.

Figure 3:
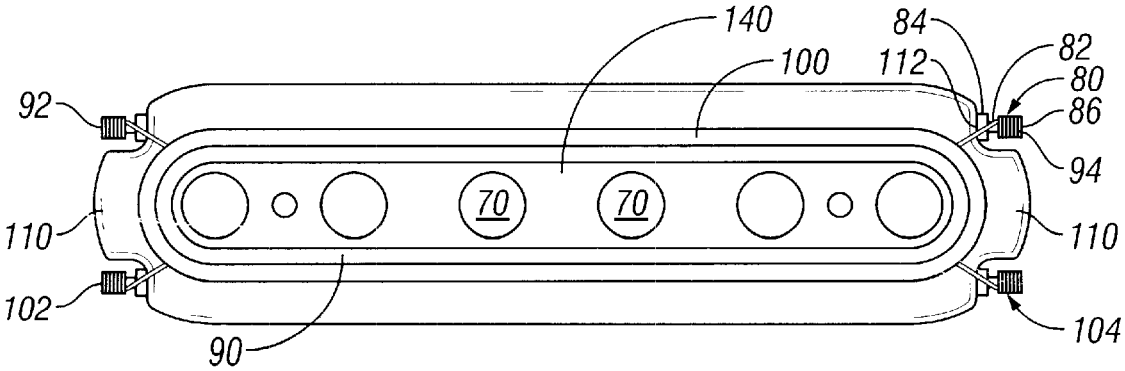
FIG. 3 is a cross-sectional view of the pickup taken along line 3—3 in FIG. 2.
Figure 4:
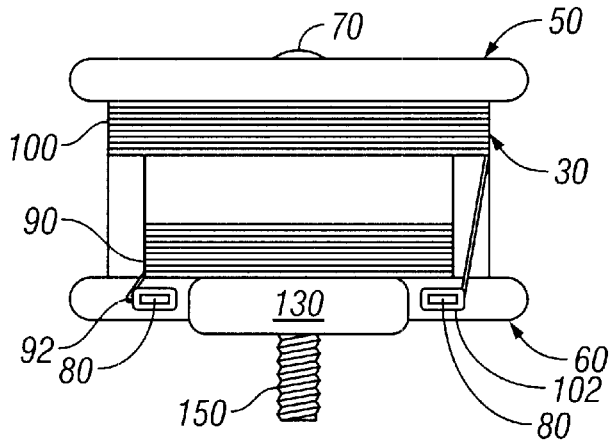
FIG. 4 is a cross-sectional view of the pickup taken along line 4—4 in FIG. 2.

FIGS. 3 and 4 are cross-sectional views of the pickup 20 showing an inner layer of wires 90 wound around a central core 140. A magnet 130 is connected to the pickup 20 in the bottom plate 60 between the walls of the inner core 140 thus causing one side of each wind to have a positive charge, while the opposite side of each wind has a negative charge. Each end of the inner wire 90 is attached to a connection point 80. An outer layer of wire 100 is wound around the inner layer of wire 90. Each end of the outer wire 100 is also connected to connection points 80. All such ends are connected to independent connection points 80 and do not share connection points 80 with other ends of the wires 90,100. For example, in the preferred embodiment shown in FIG. 3, the first end of the inner wire 90 is attached to connection point 92 while the second end of the inner wire 90 is terminated on connection point 94. The first end of the outer wire 100 is attached to connection point 102 while the second end is attached to connection point 104.

Each connection point 80 has a base 82 attached to the bobbin 40. A central post 84 protrudes out from the base 82 with a tape 86 at the outer end. Each wire 90,100 is wound around the central post 84, as well as any conductor cable (not shown).

Figure 5:
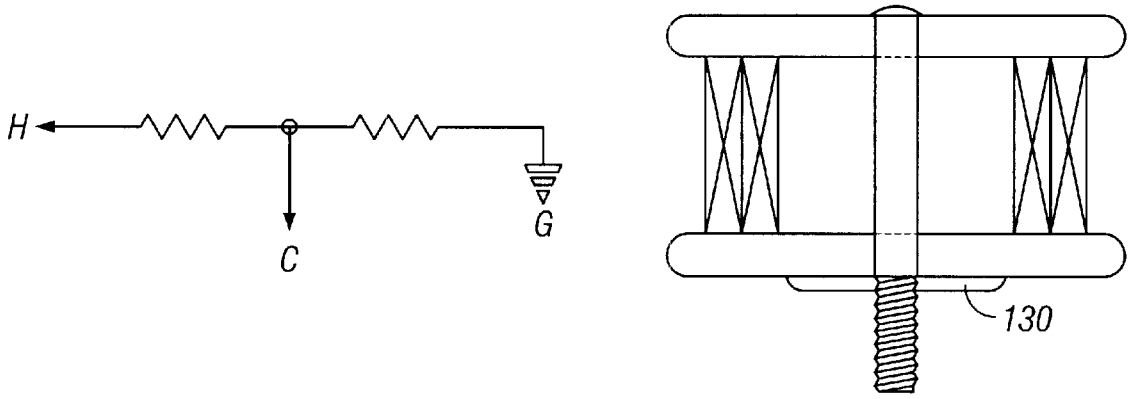
FIG. 5 is a schematic diagram of the electrical circuit of the present invention.

The inner wire 90 and the outer wire 100 each comprise a plurality of turns of two substantially different gauge wires that allow precise balancing of output and frequency response when connected in a series connection. As shown in FIGS. 3 and 5, the first end 92 of the inner wind 92 can be connected to the jack of the amplification device and is considered the hot end H. The second end 94 of the first wire 90 and the second end 104 of the second wire 100 are connected together in series creating one continuous circuit C, while the first end 102 of the second wire 100 is connected to the ground G. This arrangement creates a humbucking device that is used to reduce humming noises that are created in the amplification device by other electrical devices being located in close proximity thereto.

Single or multiple conductor cables (not shown) are connected to termination points 80 of each wire 90,100 and through use of a switching device, each wire 90,100 can be operated utilizing both sets of wire windings 90,100 or either outside 100 or inside windings 90 can be connected thereby changing output and frequency response of the pickup 20.

If two bobbins or coilforms 40 are used as a humbucking type device, the initial winds or turns of the wire, on each bobbin 40 can be connected together yielding a tonality representative of a single coil device, yet the hum cancelling operation is still effective due to the series connection of the initial winds of wire 90,100 of each bobbin 40.

Figure 6:
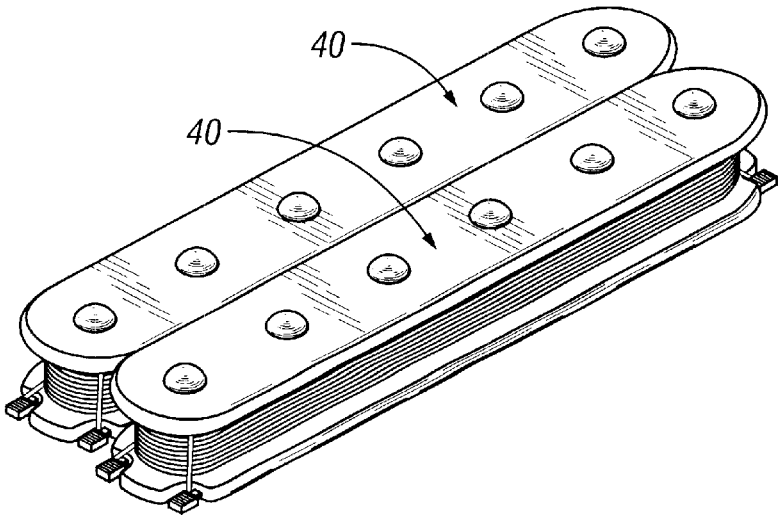
FIG. 6 is a perspective view of a second embodiment of the present invention showing two pickups side-by-side.

As shown in FIG. 6, two pickups 20 can be connected together, adjacent one another, to serve as a humbucking result. In the case of humbucking where two bobbins 40 are used, each bobbin 40 can be wound with two different gauges of magnetic wire 90,100, and the total sum of these two windings 90,100 can be of similar inductance or number of turns to create 60 cycle hum cancelling operation. Each of these bobbins 40 can have either the same number of turns of two different gauges of wire (i.e. 4,000 turns of #42 gauge and 2,000 turns of #44 gauge wire) or different numbers of turns of different gauges of wire that can be matched through inductance tuning (adding or subtracting ferrous metal plates or slugs).

Dual winding is easily performed in manufacturing by simply changing the gauge of the wire on the winding device. The bobbins or coilforms 40 can be wound with initial gauge wire 90 in large batches, then the wire gauge only is changed and the bobbins can continue to be wound in normal fashion for the secondary wind 100. By use of four pre-inserted termination points or terminals 80 in each bobbin 40, the start and finish of each wire wind 90,100 can be easily terminated.

The wire gauges used on a dual wind bobbin 40 can be of any pre-determined gauge. The desired tonality and output of the pickup device is achieved by the combination of any two gauges. For example, X number of first winds 90 and X+1 for the secondary winds 100. Another example is for there to be X initial winds 90 and X−2 secondary winds 100. Using latter gauges as in the example, many turns of the X gauge will yield higher DC resistance and accentuate midrange frequencies. Such arrangement will also lower amplitude, increase capacitance and inductance due to the number of turns necessary to achieve the desired output level. When sufficient number of turns of X gauge wire are wound to achieve desired mid-range frequencies and high end frequencies, a plurality of larger gauge wire may be used to increase the output, yet retain high frequency reproduction due to reduced inductance and capacitance of larger gauge wire. Additionally, low end frequencies will be enhanced with use of larger gauge wire, but not affect the lower mid-range as additional turns of smaller gauge wire would due to the number of additional turns required for the desired output range.

Although the particular embodiments of the invention have been described in detail herein with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A musical instrument pickup comprising:

a central core bobbin;

a first winding of wire having a first end and a second end, said first winding is wound around said central core bobbin;

a second winding of wire having a first end and a second end, said second winding is wound around said first winding;

a plurality of termination points;

said first end of said first winding and said second end of said second winding are attached to a respective one of said plurality of termination points; and said plurality of termination points are capable of being connected to an amplification source so that the tones of the instrument strings are amplified and the humming of the instrument strings is reduced.

2. The musical instrument pickup according to claim 1, wherein:

said gauge of said first winding is different than said gauge of said second winding.

3. The musical instrument pickup according to claim 2, wherein:

said number of winds of said second winding are greater than said winds of said first winding.

4. The musical instrument pickup according to claim 2, wherein:

said number of winds of said second winding are less than said winds of said first winding.

5. The musical instrument pickup according to claim 3, wherein:

said termination points are metal.

6. The musical instrument pickup according to claim 3, wherein:

at least one end of each of said first and second windings are connected together thereby placing the windings in series with one another.

7. The electromechanical pickup of claim 3, wherein:

each end of said first and second windings are connected to a respective termination point.

8. An electromechanical pickup for use with a musical instrument, the pickup comprising:

a bobbin with a central core;

a first wire wound around said core, said first wire having two ends;

a second wire wound around said first wire, said second wire having two ends;

a plurality of termination points, one for each end of each wire;

at least one end of each of said first and second windings is attached to a respective termination point; and said plurality of termination points are capable of being connected to an amplification source so that the tones of the instrument strings are amplified and the humming of the instrument strings is reduced.

9. The electromechanical pickup of claim 8, wherein:

the gauge of said wire of said first winding is a different gauge than the gauge of said wire of said second winding.

10. The electromechanical pickup of claim 9, wherein:

said number of turns of said second winding is greater than or less than said number of turns of said first winding.

11. The electromechanical pickup of claim 10, wherein:

at least one end of each of said first and second windings are connected together thereby placing the windings in series with one another.

12. The electromechanical pickup of claim 10, wherein:

each end of said first and second windings are connected to a respective termination point.

13. A musical instrument pickup comprising:

a top plate;

a bottom plate;

a central core between said top plate and said bottom plate;

a magnet located adjacent said bottom plate;

a first winding of wire having a first end and a second end, said first winding is wound around said central core bobbin;

a second winding of wire having a first end and a second end, said second winding is wound around said first winding;

a plurality of termination points;

said first end of said first winding and said second end of said second winding are attached to a respective one of said plurality of termination points; and said plurality of termination points are capable of being connected to an amplification source so that the tones of the instrument strings are amplified and the humming of the instrument strings is reduced.

* * * * *